US005909763A

United States Patent [19]

Link et al.

[11] Patent Number: 5,909,763

[45] Date of Patent: Jun. 8, 1999

[54] INSULATIVE WINDOW ASSEMBLY

[76] Inventors: Paul G. Link, R.D. 1 Box 43; Jeffrey T. Turner, R.D. 5 Box 397A, both of Bedford, Pa. 15522

[21] Appl. No.: 08/991,172

[22] Filed: Dec. 16, 1997

[51] Int. Cl.[6] ..... E06B 9/56

[52] U.S. Cl. ..... 160/269; 160/290.1

[58] Field of Search ..... 160/269, 98, 266, 160/267.1, 268.1, 290.1, 280, 281, 288, 289

[56] References Cited

U.S. PATENT DOCUMENTS

| | | | |
|---|---|---|---|
| 4,079,772 | 3/1978 | Klaenhammer et al. | 160/268.1 |
| 4,126,174 | 11/1978 | Moriarty . | |
| 4,282,919 | 8/1981 | Teno . | |
| 4,317,480 | 3/1982 | Phelps . | |
| 4,357,978 | 11/1982 | Keller . | |
| 4,369,827 | 1/1983 | Anderson . | |
| 4,398,585 | 8/1983 | Marlo . | |
| 4,409,758 | 10/1983 | Dickerson . | |
| 4,419,982 | 12/1983 | Eckels | 160/268.1 X |
| 4,436,137 | 3/1984 | Charles | 160/242 |
| 4,499,937 | 2/1985 | Waine . | |
| 4,510,986 | 4/1985 | Schwankl . | |
| 4,516,618 | 5/1985 | Gardner . | |
| 4,531,562 | 7/1985 | Swanson . | |
| 4,562,675 | 1/1986 | Baigas . | |
| 4,597,430 | 7/1986 | Marquez . | |
| 4,651,796 | 3/1987 | Gardner . | |
| 4,987,943 | 1/1991 | Charest | 160/269 |
| 5,092,388 | 3/1992 | Evers | 160/269 |
| 5,195,594 | 3/1993 | Allen et al. | 160/268.1 X |
| 5,720,137 | 2/1998 | Rodriquez | 160/269 X |

*Primary Examiner*—David M. Purol
*Attorney, Agent, or Firm*—John J. Elnitski, Jr.

[57] ABSTRACT

Disclosed is an insulative window assembly that is easy to operate and attractive to the user. The insulative window assembly incorporates a blind and unique sealing frame. The sealing frame appears to be a window molding, while allowing the blind to be move along the sealing frame in order to seal a window space. A blind pull attached to the blind allows the blind to be positioned anywhere along the sealing frame.

19 Claims, 11 Drawing Sheets

INSULATIVE WINDOW ASSEMBLY

BACKGROUND

Home owners and owners of historic buildings are constantly in search of a product to insulate their window space in order to prevent air infiltration, while retaining the original look of the windows. One of the products currently on the market is a clear plastic film which is attached to the inside or outside frame of the window. This film is stretched tightly across the window space by various methods to form an airtight seal, thereby forming an insulate layer about the window space. This product does not allow for removal on warmer days and can be damaged easily.

Blind type window insulative covers are available that attach to the window frame in order to seal the window space. There have been many variations of this concept. Some designs have used strips of Velcro, magnets or steel in combination with a magnetic strip. The strips are applied to the frame and the blind, where the strips are then interconnected to form a seal when the blind covers the window. The blinds of this type requires some care to properly place the blind, in order to form a proper seal to prevent air infiltration from the window space. This type is not aesthetically pleasing to the owner due to the strips being visible and detracting from the beauty of the window design. Other designs incorporate a frame or rail which attaches to the window frame to guide the blind and seal the window space. The frame or rail type design has not been very successful on the market due its complexity of installation and operation. Also, the frame or rail designs have not been aesthetically pleasing to the eye and are relatively expensive due to materials used.

It is an object of the present invention to provide an insulative window assembly that is easy to operate and attractive to the user.

SUMMARY OF THE INVENTION

The present invention provides an insulative window assembly for a window space. The assembly includes a blind and a sealing frame. The sealing frame includes a blind cover mounted at the top of the window space, a base mounted at the bottom of the window space, a rail back mounted along each side of the window space, and a rail face rotatably fixed to each rail back. The rail face closes against the rail back and traps the blind between the rail back and the rail face. A first strip magnet mounted along the rail back. A second strip magnet mounted to the rail face which is opposite in polarity to the first strip magnet. The first and second strip magnets are mounted to aligned in parallel against each other when the rail face closes against the rail back. The blind is trapped between the first and second strip magnets which provides sealing of the sides of the window space due to attraction of the magnets. The blind cover holds the blind and seals the top of the window space, while a base seals the bottom of the window space. A blind pull is attached to the blind. The blind pull includes an operating mechanism which rotates the rail face open and close.

DETAILED DESCRIPTION

Figure 1:
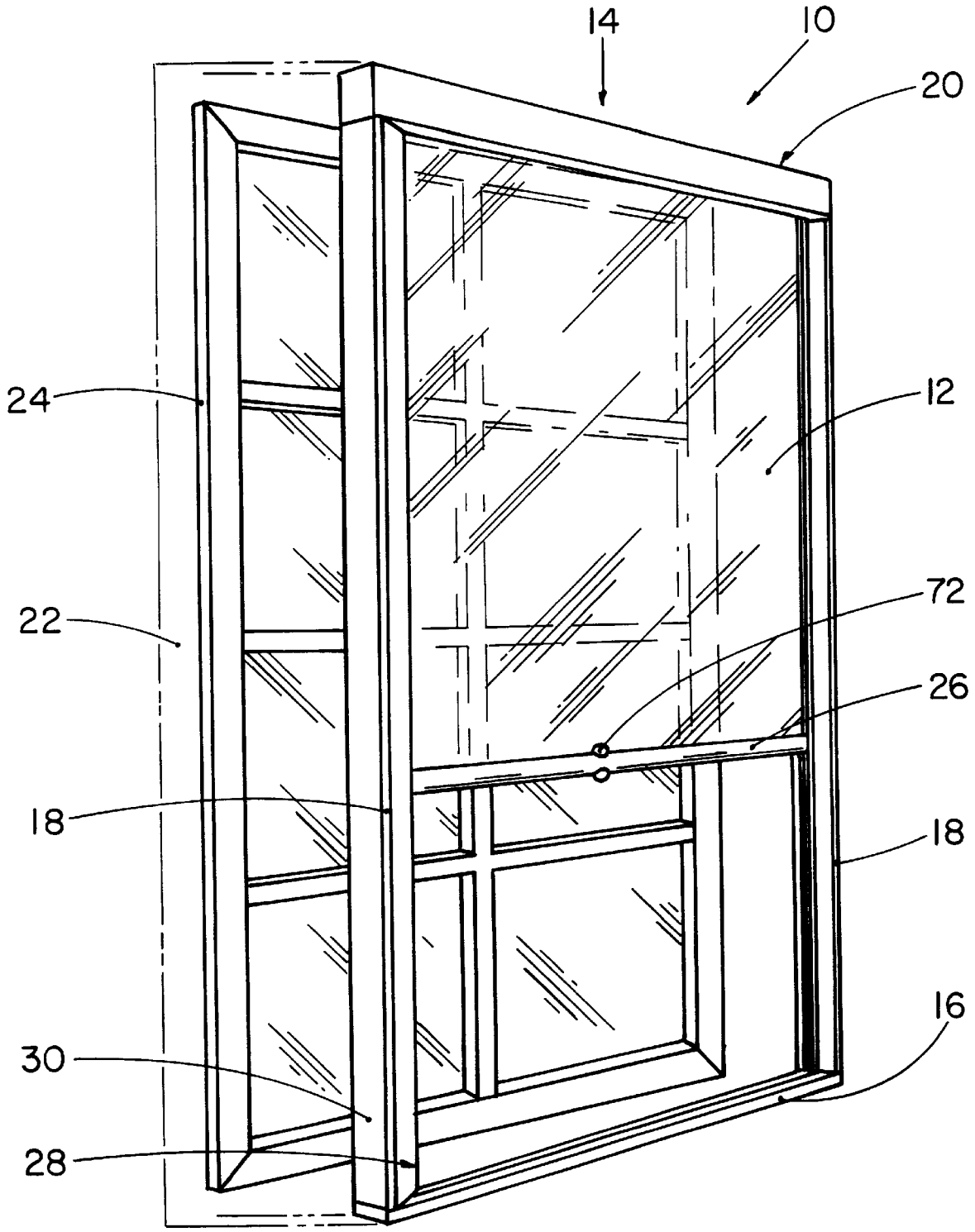
FIG. 1 is a perspective view of the insulative window assembly according to the present invention.

The present invention provides an insulative window assembly 10 as shown in FIG. 1. The assembly 10 incorporates a blind 12 in combination with a sealing frame 14 to prevent air infiltration. The sealing frame 14 includes a base 16, side rails 18 and a blind cover 20. The sealing frame 14 mounts to area 22 about the window space 24 and can be secured by adhesives or standard mounting hardware. If mounting hardware is utilized, a gasket type seal should be used between the mounting area 22 and the sealing frame 14 near the window space 24 in order to provide an airtight seal. The sealing frame 14 can be manufactured from numerous materials to have an outside appearance of any of the popular moldings used in the window industry. The blind 12 includes a blind pull 26 which interacts with the sealing frame 14 to position the blind 12 and seal the window space 24.

As illustrated in FIGS. 2, 7–10, each side rail 18 includes a rail face 28 and a rail back 30. The rail backs 30 mount to the area 22 about the sides of the window space 24. The outside of the rail face 28 can be shaped as desired to have an appearance of a window molding. As shown in FIGS. 2, 7–10, the rail face 28 has a male groove component 32 which interacts with a female groove component 34 of the rail back 30, thereby forming a hinge. The female groove component 34 is formed to retain the male groove component 32. The rail face 28 rotates about the male-female groove component 32, 34 connection. The male-female groove component 32, 34 connection of the rail face 28 and rail back 30 can be replace by any other type of hinging arrangement. A strip magnet 36 is mounted along the length of the rail face 28 and another strip magnet 38 is mounted along the length of the rail back 30. Magnets 36 and 38 are mounted so they are aligned to contact each other when the rail face 28 is closed against the rail back 30. Magnet 36 and magnet 38 are opposite in polarity to each other so they attract each other when aligned. The rail face 28 includes a rail pin 40 and an indentation 42. The rail pin 40 interacts with components of the blind cover 20 during movement of the rail face 28. The indentation 42 interacts with components of the blind pull 26 attached to the blind 12. Both the rail pin 40 and indentation 42 will be discussed during the operational explanation of the insulative window assembly 10.

FIGS. 1–3 and 9–10 show the components of the blind cover 20. The blind cover 20 includes a cover face 44, cover back 46, top seal 48 and the blind 12 on a roller mechanism (not shown). The blind 12 and roller mechanism can be of any standard type that is available on the market. Usually, the user will desire a blind material which produces the most insulative results and while being see-through. The cover back 46 mounts to the area 22 above the widow space 24. The cover back 46 also includes two sides 50 extending outward away from the window. Each side 50 of the cover back 46 includes channels 52 to receive and retain the roller mechanism in place. The bottom edge of the cover back 46 and sides 50 are formed to butt against the top of the rail backs 30. An adhesive or sealant can used where the cover back 46 and rail back 30 butt together in order to provide an airtight seal. The rail back 30 and the cover back 46 can also be manufactured so that they interlock (not shown) with each other to provide the airtight seal. The cover back 46 also includes a strip magnet 54 near the window space 24, which runs along the length of the cover back 46.

FIGS. 2 and 7–10 show the top seal 48. The top seal 48 shown is a flat bar having a slot 56 at each end and a strip magnet 58. The strip magnet 58 mounts, so that it is parallel to and can be aligned with the strip magnet 54 of the cover back 46. The magnet 58 should be opposite in polarity to the magnet 54 of the cover back 46 so they attract each other when aligned. The ends of the top seal 48 rest on top of the two rail faces 28, where the slots 56 are slipped over the rail pins 40. The cover face 44 includes a front face 60 and two cover face sides 62. The cover face sides 62 slide inside the sides 50 of the cover back 46. The cover face sides 62 are notched to allow them to pass over the roller mechanism and retain the roller mechanism in place. The cover face 44 can be glued to the cover back 46 or made to interlock with the cover back 46 (not shown). The cover face 44 should mount to allow for movement of the top seal 48 within the blind cover 20. A top (not shown) for the blind cover 20 can be easily provided if desired in order to seal the blind cover 20. The top is not necessary for the prevention of air infiltration, but would prevent the collection of dust on the blind 12.

Figure 2:
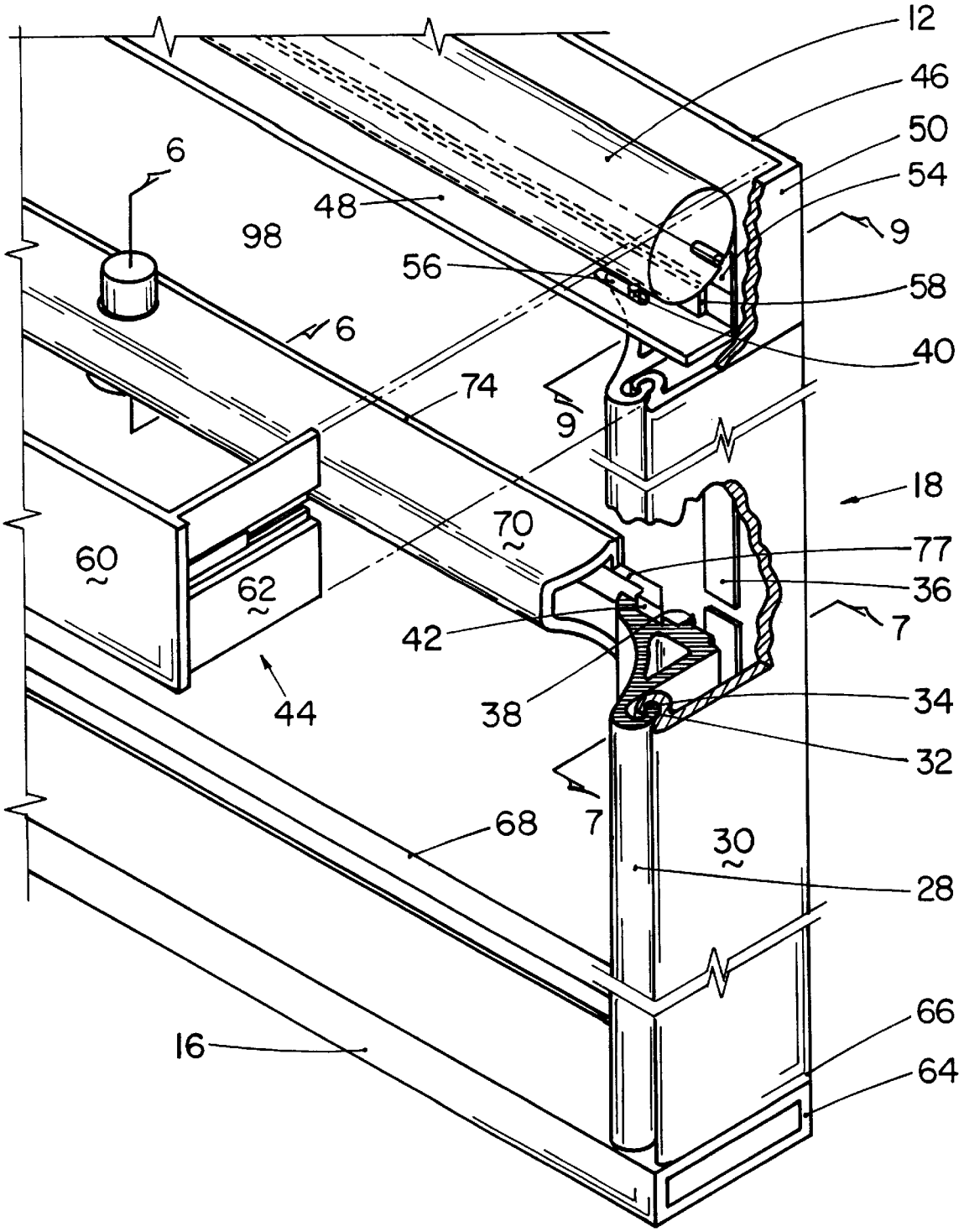
FIG. 2 is a partial sectioned and cutaway perspective view of the components of FIG. 1.
Figure 3:
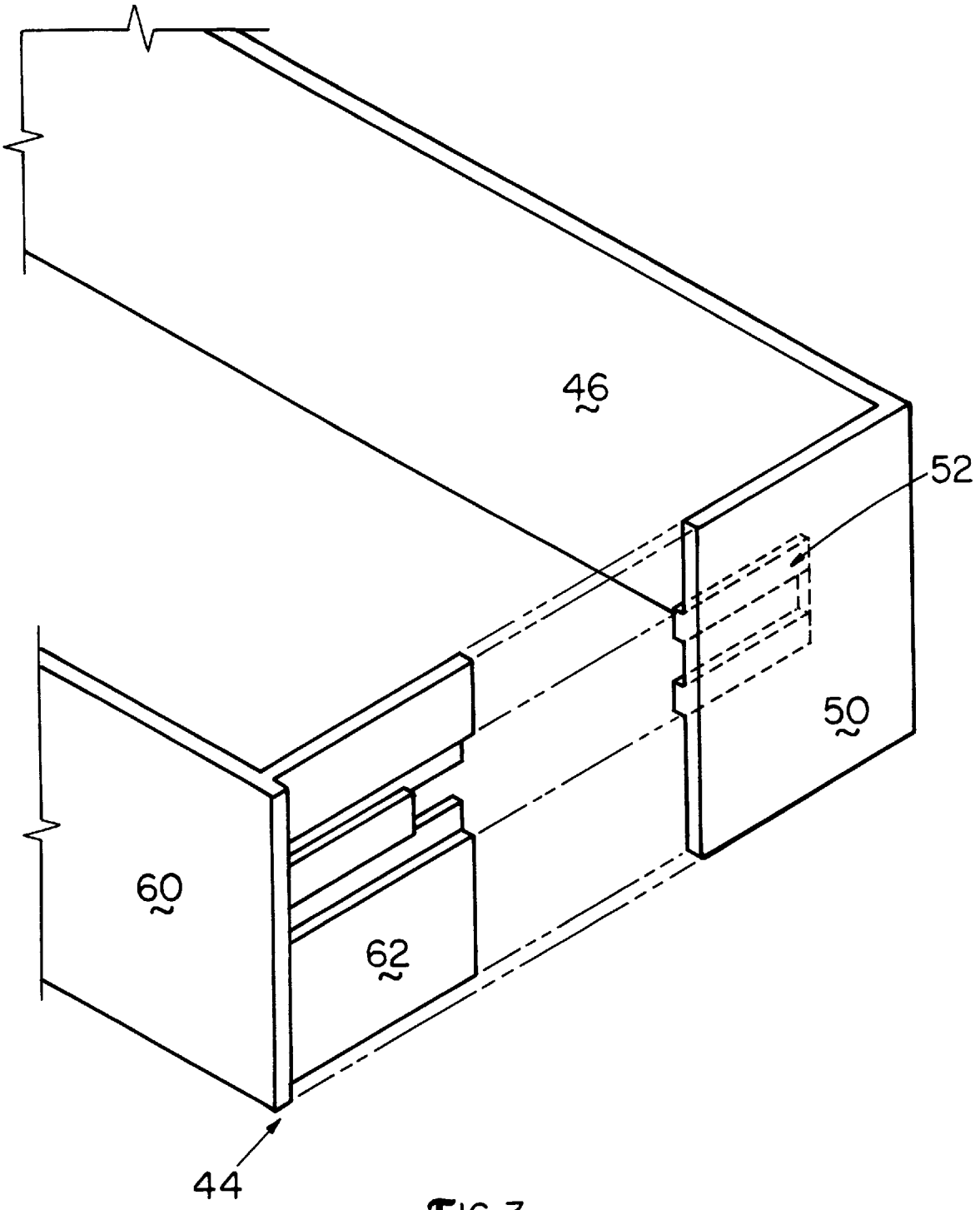
FIG. 3 is a partial perspective view of a cover face and cover back according to the present invention.
Figure 4:
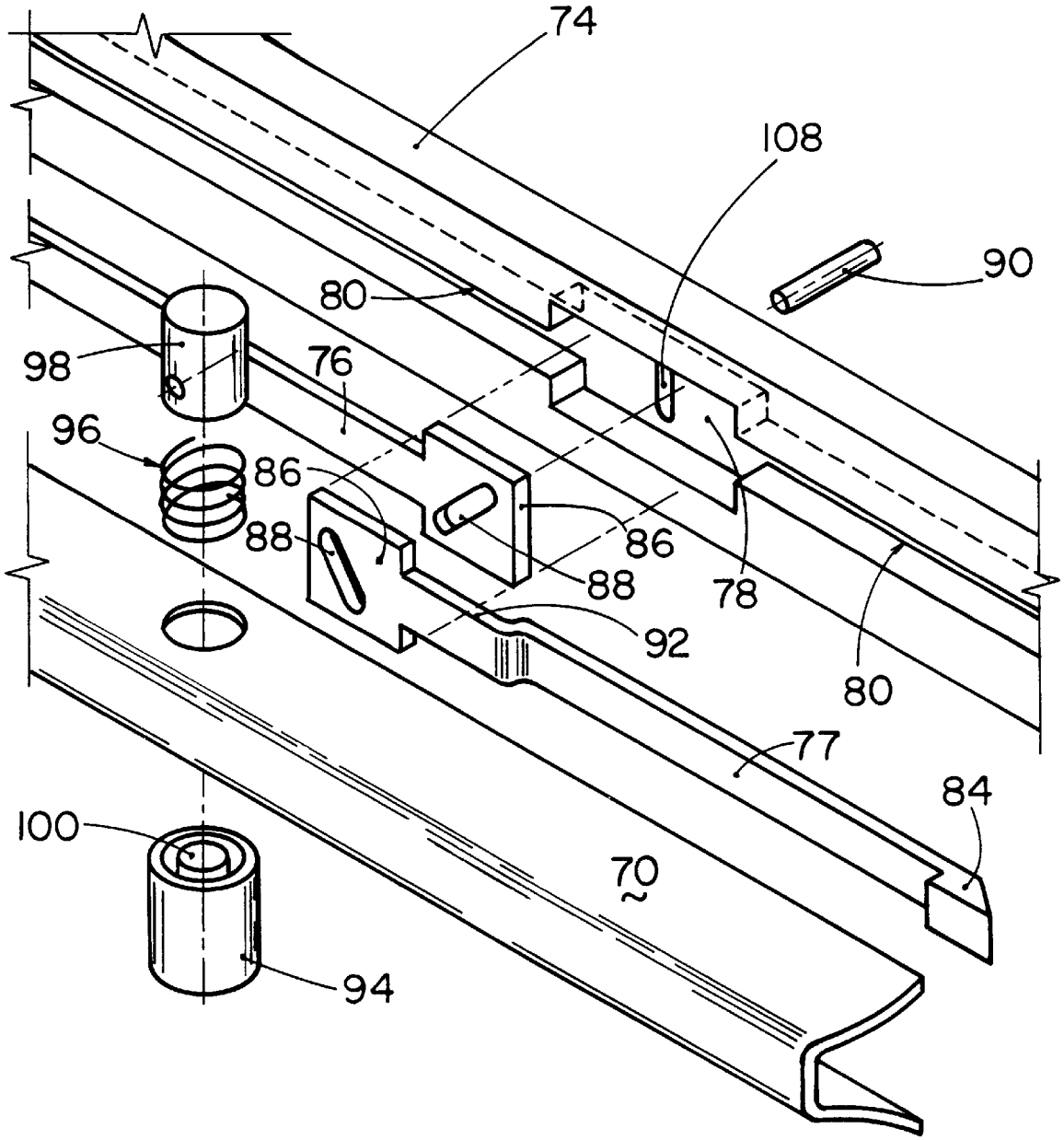
FIG. 4 is a partial exploded view of a pull bar according to the present invention.
Figure 5:
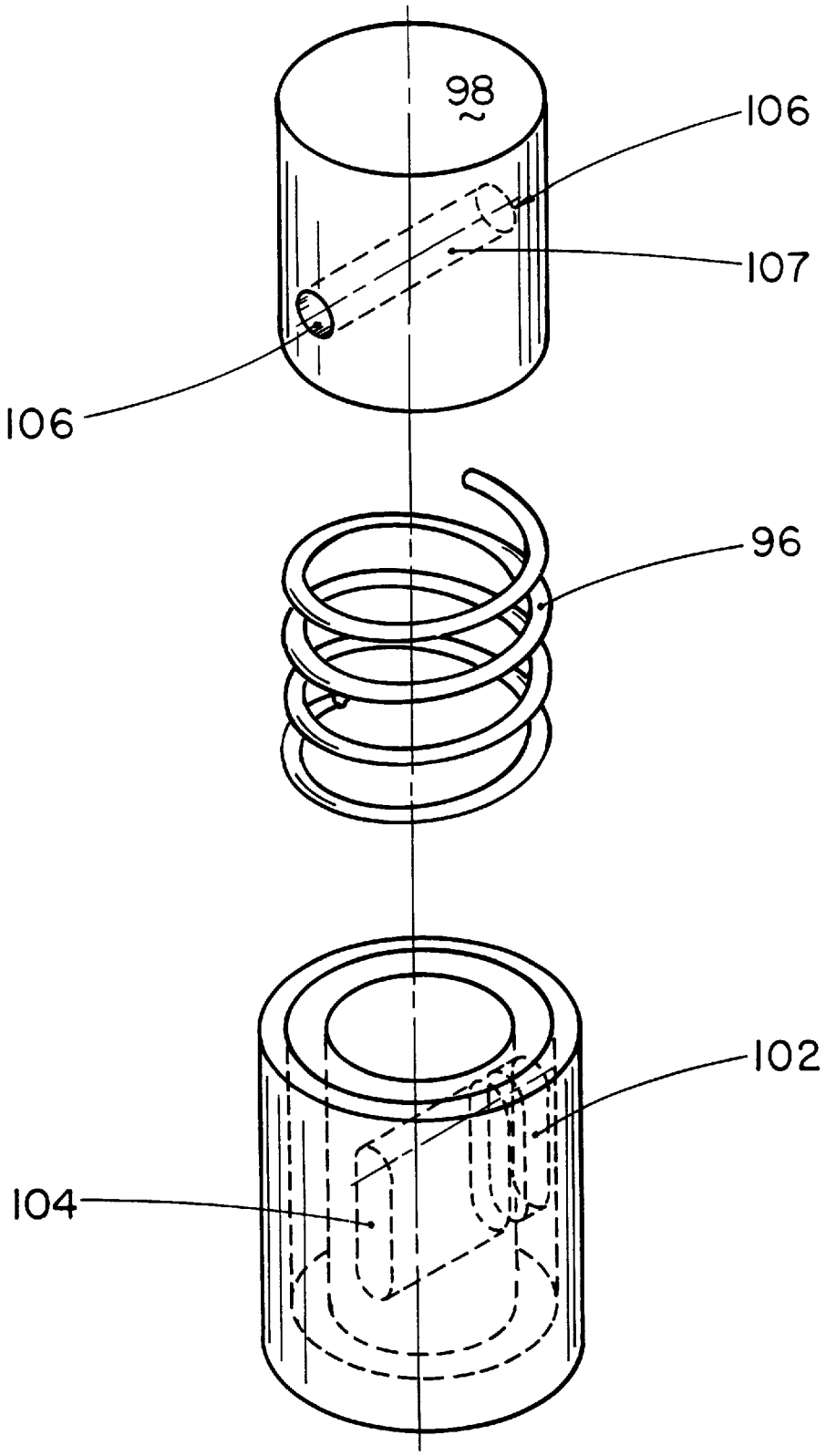
FIG. 5 is an exploded view of a operating mechanism according to the present invention.
Figure 6:
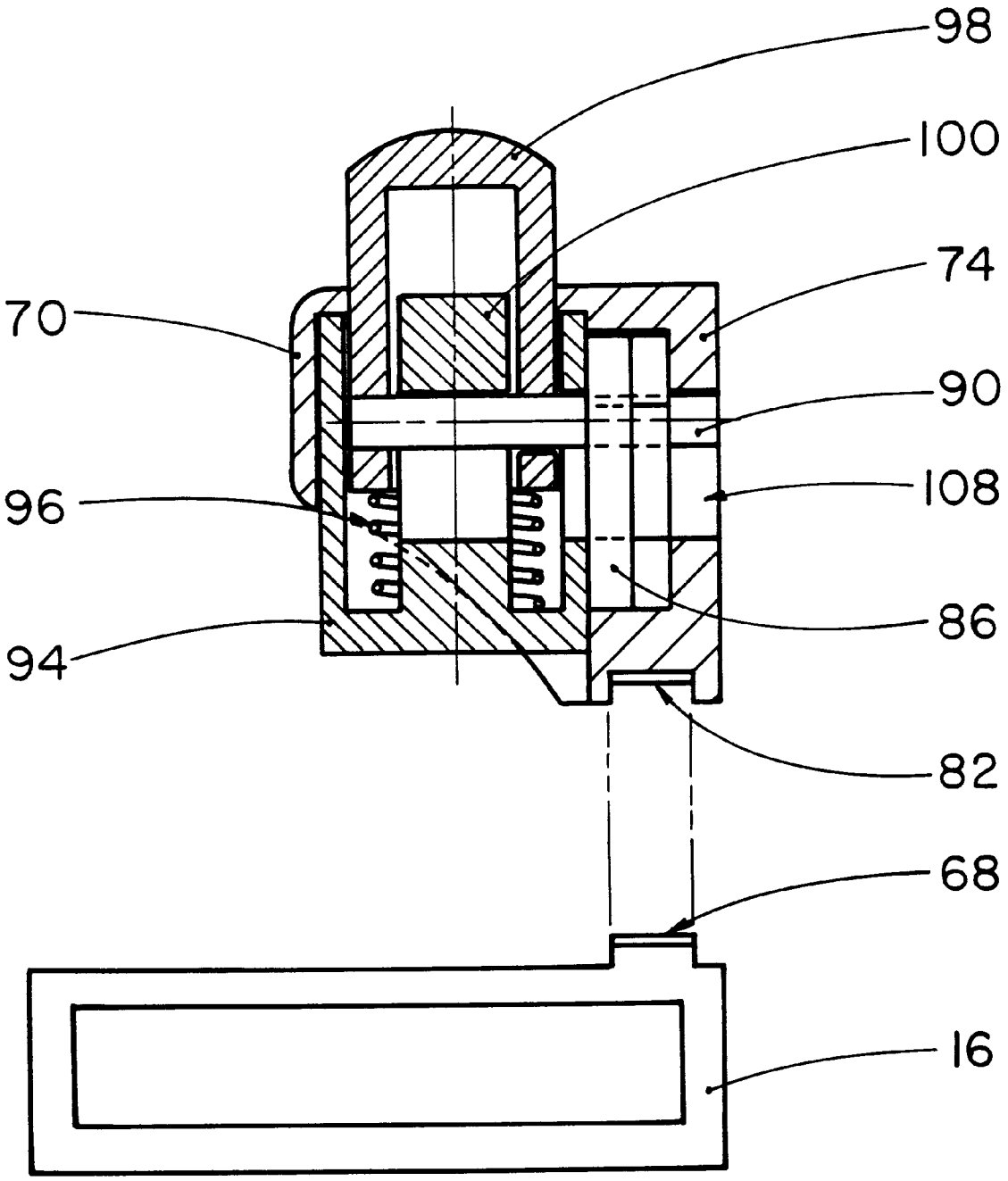
FIG. 6 is a cross-sectional view 6—6 of FIG. 2.
Figure 7:
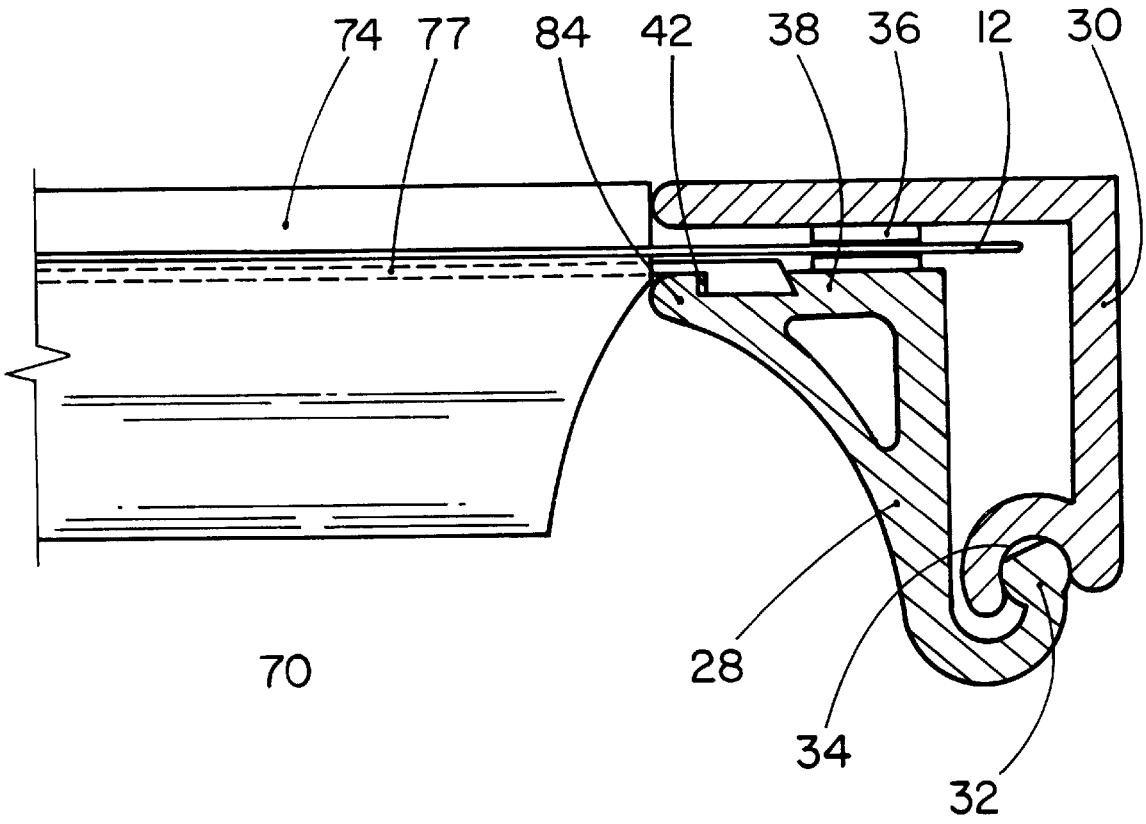
FIG. 7 is a cross-sectional view 7—7 of FIG. 2 in the closed position.
Figure 8:
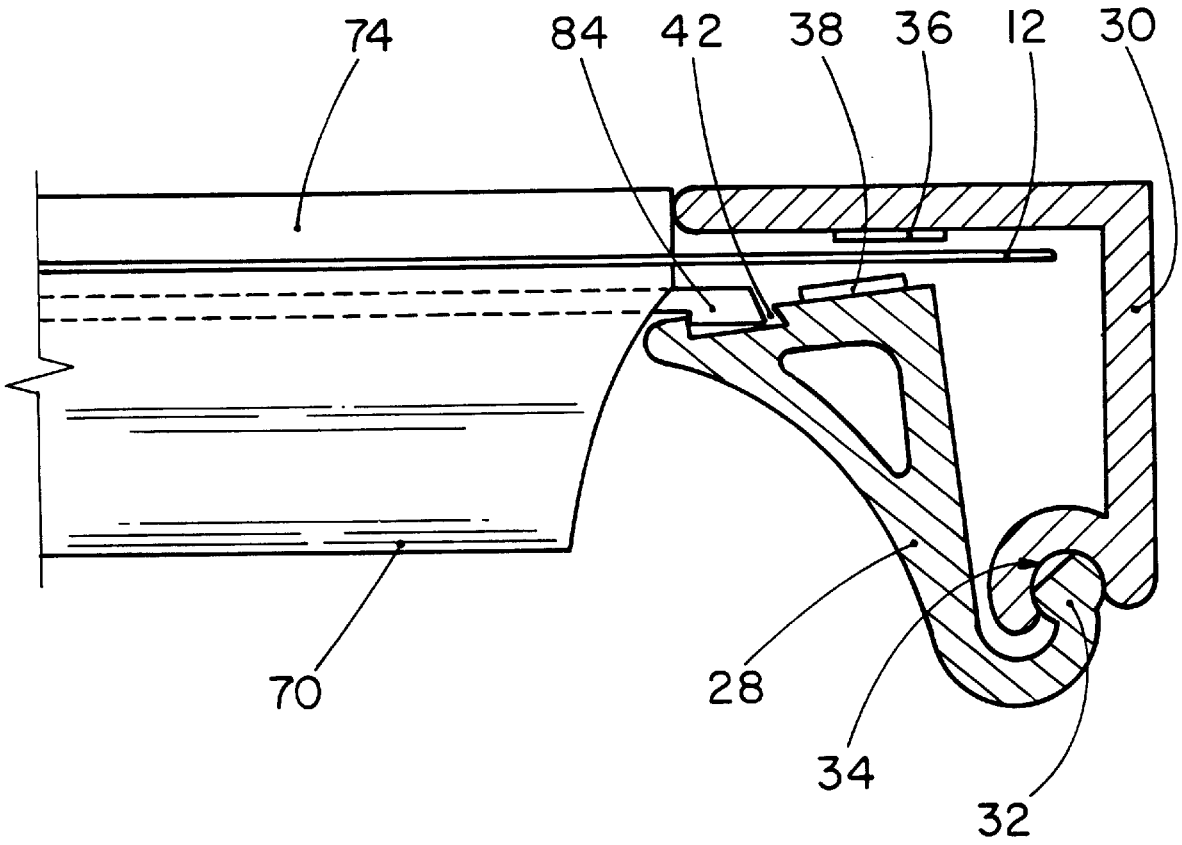
FIG. 8 is a cross-sectional view 7—7 of FIG. 2 in the open position.
Figure 9:
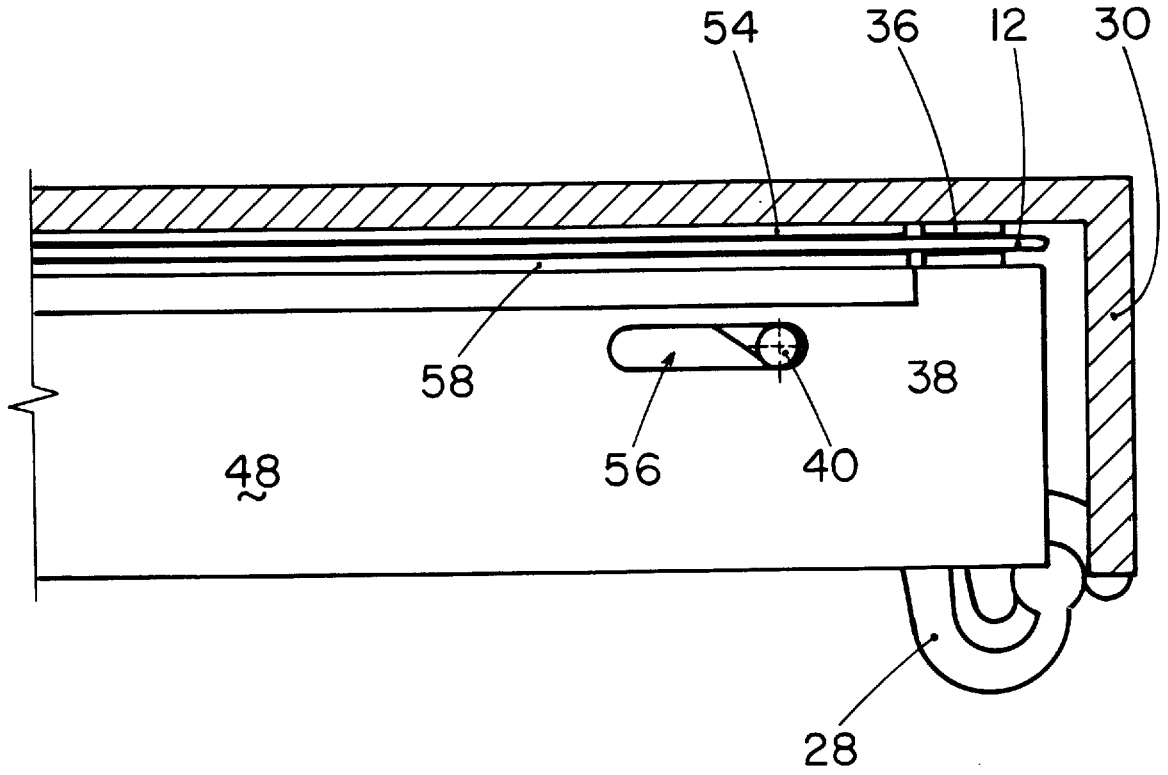
FIG. 9 is a cross-sectional view 9—9 of FIG. 2 in the closed position.
Figure 10:
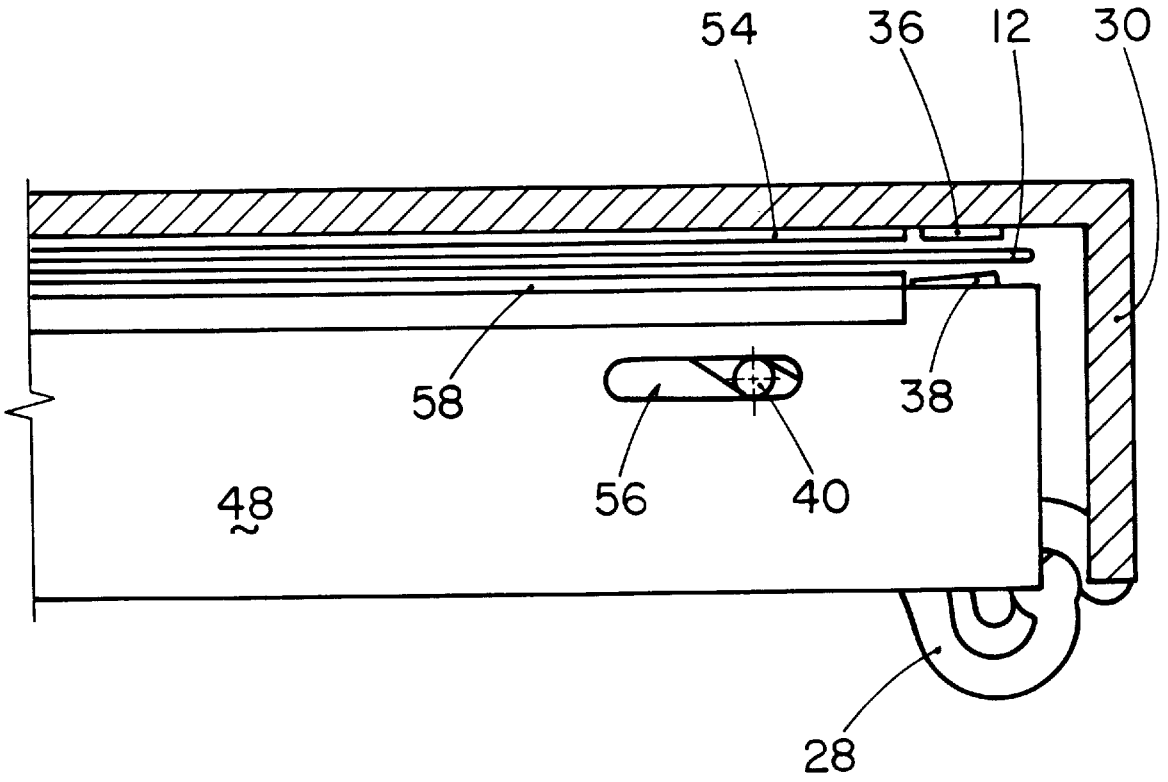
FIG. 10 is a cross-sectional view 9—9 of FIG. 2 in the open position.

FIGS. 1–2 and 6 show the base 16. The base 16 mounts to the area 22 at the bottom of the widow space 24 using adhesives or mounting hardware. If mounting hardware is used, a gasket or sealant should be used between the base 16 and the mounting area 22 to prevent air infiltration. The base 16 should be mounted so that its ends 64 butt against the bottom 66 of each rail back 30. Where the base 16 and rail back 30 butt should be sealed by an adhesive or sealant. Also (not shown), the base 16 and rail back 30 can be manufactured so that they interlock with each other to provide the airtight seal. The base 16 includes a strip magnet 68 on top facing upward toward the blind cover 20.

FIGS. 1–2, 4 and 6–10 show the blind pull 26. The blind pull 26 includes a handle 70, operating mechanism 72, pull bar 74, and arms 76, 77. The blind 12 attaches to the back of the pull bar 74 by any of the known manufacturing techniques. The pull bar 74 includes a cavity 78 and guides 80 that receive and allow movement of the arms 76, 77. The pull bar 74 includes a strip magnet 82 attached to the bottom edge of the pull bar 74 to interact with the magnet 68. The strip magnet 82 should be opposite in polarity to the strip magnet 68 of the base 16 so they attract each other when aligned. Each arm 76, 77 includes a tab 84 at one end and an engagement plate 86 at the other end. The engagement plate 86 of each arm 76, 77 is positioned in the cavity 78 and includes a slot 88 to receive a button pin 90. The slots 88 are positioned, so that when the engagement plates 86 are in the cavity 78, the slots 88 angle towards each other in an upward direction. The slots 88 are aligned so that the button pin 90 fits through both of them at top of each slot 88. Note that arm 77 has a dog leg 92 near the engagement plate 86. The dog leg 92 allows the engagement plates 86 to overlap in the cavity 78. The tabs 84 extend from the arms 76, 77 and are shaped to fit into the indentations 42 of the rail face 28. The handle 70 provides a grip to pull the blind 12 and provides for containment of the operating mechanism 72. The handle 70 is attached to the pull bar 74 and is formed so it does not interfere with movement of the arms 76, 77. It is not necessary to specify how the handle 70 is attached to the pull bar 74, as any of the known techniques know in the art can be used.

FIGS. 1–2 and 4–6 show the operating mechanism 72. The operating mechanism 72 includes a housing 94, a return spring 96, a button head 98 and the button pin 90. The housing 94 is embedded in the handle 70 and includes a button head guide 100 extending upward in the center of the housing 94. The housing 94 has a button pin slot 102 in its rear side and the button head guide 100 has button pin slot 104. The slots 102 and 104 are aligned with each other to receive the button pin 90. The button head 98 is hollow to allow it to slide up and down the button head guide 100. The button head 98 also has two holes 106 and a pass-through 107 to receive the button pin 90. The return spring 96 fits over the button head guide 100 and against the bottom edge of the button head 98. The bottom edge of the button head 98 could also be recessed(not shown) to accept the top of the spring 96. When the blind pull 74 is assembled, the button pin 90 is inserted through a slot 108 in the cavity 78, through the top of the slots 88 in the engagement plates 86, through the slot 102 of the housing 94, through one hole 106 of the button head 98, through the pass-through 107, through the slot 104 in the button head guide 100 and finally the other hole 106 of the button head 98. There are many techniques know in the art for removably securing the button pin 90 in place and therefore securing the button pin 90 is not part of this disclosure.

Figure 11:
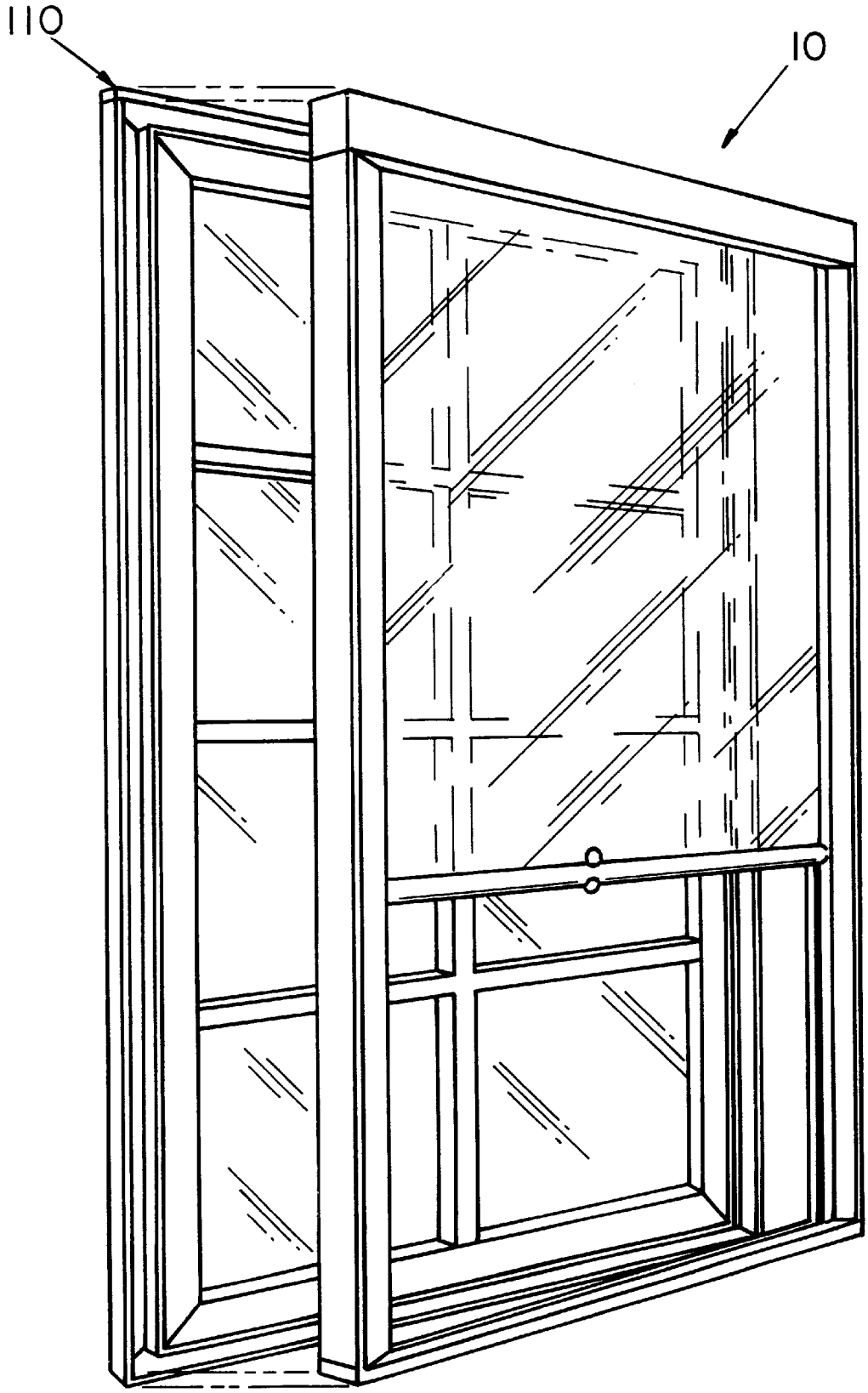
FIG. 11 is a perspective view of the present invention of FIG. 1 using a mounting base.

Now that all the components have been described, the mounting and operation of the window assembly 10 will be explained. As described above the cover back 46, rail back 30 and base 16 can be directly mounted to the area 22 about the window space 24 and butted together. Another method of mounting the sealing frame 14 is to use a mounting base 110 as shown in FIG. 11. Where the mounting base 110 mounts to the area 22 about the window space 24 with a seal or gasket between the mounting base 110 and area 22 near the window space 24. The mounting base 110 would be designed to sealably interlock with the blind cover 20, side rails 18 and base 16 of the sealing frame 14. This would ease assembly of the insulative window assembly 10, because the squaring of components would be automatic, once the mounting base 110 is mounted properly. It is not necessary to specify the interlocking feature of the mounting base 110 and the components of the sealing frame 14, as any of the known techniques know in the art can be used.

The blind pull 26 is the key to the operation of the insulative window assembly 10. When the button head 98 is depressed, the button pin 90 moves downward. The downward movement of the button pin 90 forces the arms 76, 77 to move toward each other due to the angled slots 88 of the engagement plates 86. When the arms 76, 77 move toward each other, the tabs 84 slide partially out of the indentations 42 and force the rail faces 28 to rotate about the groove components 32, 34 and away from the rail back 30. While the rail faces 28 are rotating, the rail pin 90 of each rail face 28 moves the top seal 48 and its magnet 58 away from the magnet 54 of the cover back 46. The blind 12 of the assembly 10 is threaded horizontally between magnets 54, 58 and vertically between magnets 36, 38. When the button head 98 is depressed the magnets 54, 58 and magnets 36, 38 separate from each other due to the movement of the arms 76, 77, tabs 84 and rail faces 28 as described above. This allows the user to pull the blind 12 downward with the blind pull 26. The separation of the magnets 54, 58 and 36, 38 only has to be enough to allow the blind 12 to pass. The user can pull the blind pull 26 down to the base 16 so that the magnets 68, 82 make contact. Once the magnets 68, 82 make contact the user can release the button head 98. When the user releases the button head 98, the return spring 96 pushes the button head 98 upward, thereby forcing the arms 76, 77 away from each other due to the upward movement of the button pin 90 in the slots 88 of the engagement plates 86. As the arms 76, 77 move away from each other, the tabs 84 of the arms 76, 77 slide back into the indentations 42 and force the rail face 28 to close against the rail back 30. When the rail face 28 closes it forces magnets 54, 58 and magnets 36, 38 to contact each other, thereby trapping the blind 12 between them. The trapping of the blind 12 by magnets 54, 58 and 36, 38 provides an airtight seal at the top and sides of the window space 24, as well as holding the blind 12 in place. The now connected magnets 68, 82 of the blind pull 26 and the base 16 provide an airtight seal at the bottom of the window space 24. When the blind 12 is in the full down position as described above, an airtight seal is provided about the window space 24 which prevents air infiltration. An important feature of the insulative window assembly 10 is that the blind pull 26 can be positioned any where along the side rails 18 by releasing the button head 98, because the magnets 54, 58 and 36, 38 will hold the blind 12 in place. Therefore, on warmer days the user can depress the button head 98 which operates the components as described above and position the blind 12 at any desired height along the side rails 18 by releasing the button head 98. It is envisioned that the present invention could be practiced without the magnets disclosed above, as long as the blind is sealably trapped between the other components described.

While embodiments of the invention has been described in detail herein, it will be appreciated by those skilled in the art that various modifications and alternatives to the embodiment could be developed in light of the overall teachings of the disclosure. Accordingly, the particular arrangements are illustrative only and are not limiting as to the scope of the invention which is to be given the full breadth of the appended claims and any and all equivalents thereof

We claim:

1. An insulative window assembly, for a window space having two sides, a top and bottom, comprising:

a blind cover mounted at the top of the window space;

a blind mounted in said blind cover;

a rail back mounted along each side of the window space;

a rail face rotatably fixed to each rail back for closing against said rail back and trapping said blind between said rail back and said rail face in order to seal the sides of the window space;

a first strip magnet mounted along said rail back;

a second strip magnet opposite in polarity to said first strip magnet mounted along said rail face; and said first and second strip magnets mounted to aligned in parallel against each other when the rail face closes against the rail back, thereby trapping said blind between said first and second strip magnets and providing the sealing of the sides of the window space due to attraction of the strip magnets.

2. The insulative window assembly of claim 1, further including a blind pull attached to said blind for pulling the blind along and between said rail backs and rail faces, said blind pull including at least one arm having a first end interconnected to each of said rail faces to open and close said rail faces and including an operating mechanism connected to a second end of said arms in order to manipulate said arms to open and close said rail faces.

3. The insulative window assembly of claim 2, wherein said operating mechanism includes a button means to operate said arms.

4. The insulative window assembly of claim 2, wherein said rail faces include indentations and said arms include tabs at said first end which fit into said indentations.

5. The insulative window assembly of claim 2, wherein said arms include slotted plates at said second ends; wherein said operating mechanism includes a housing, a button head guide extending upward inside said housing, a button head which slides over said guide, a return spring between said housing and said button head, a button pin; and wherein said housing has one slot, said button head guide has two slots and said button head has at least one hole, whereby all slots and holes of said plates and operating mechanism are aligned to receive said button pin.

6. The insulative window assembly of claim 1, wherein said blind cover further includes a cover back and a top seal having two ends, said top seal movable against said cover back to trap the blind against said cover back, thereby sealing the top of the window space.

7. The insulative window assembly of claim 6, wherein said rail face further includes a rail pin and said top seal further includes a slot at each end; and wherein said rail pin of each rail face is inserted into one of said slots of said top seal, so that said top seal moves away from said cover back when said rail faces open away from said rail back.

8. The insulative window assembly of claim 6, wherein said cover back includes a third strip magnet and said top seal includes a fourth strip magnet; and wherein said third and fourth strip magnets are opposite in polarity and are oriented to face each other in order to trap the blind between each other to form a seal.

9. The insulative window assembly of claim 5, further including a base mounted at the bottom of the window space and below said rail backs; a fifth strip magnet mounted to the bottom of said blind pull; and sixth magnet opposite in polarity to said fifth strip magnet mounted to said base so that it faces said fifth strip magnet and interconnects with said fifth strip magnet when the blind pull is against said base.

10. The insulative window assembly of claim 1, wherein said rail back includes a female groove and said rail face includes a male groove which fits into said female groove to allow said rail face to rotate about said rail back.

11. An insulative window assembly, for a window space having two sides, a top and bottom, comprising:

a blind cover mounted at the top of the window space;

a blind mounted in said blind cover;

a rail back mounted along each side of the window space;

a rail face rotatably fixed to each rail back for closing against said rail back and trapping said blind between said rail back and said rail face in order to seal the sides of the window space;

a blind pull attached to said blind for pulling the blind along and between said rail backs and rail faces, said blind pull including at least one arm having a first end interconnected to each of said rail faces to open and close said rail faces and including an operating mechanism connected to a second end of said arms in order to manipulate said arms to open and close said rail faces.

12. The insulative window assembly of claim 11, wherein said rail faces include indentations and said arms include tabs at said first end which fit into said indentations.

13. The insulative window assembly of claim 11, wherein said arms include slotted plates at said second ends; wherein said operating mechanism includes a housing, a button head guide extending upward inside said housing, a button head which slides over said guide, a return spring between said housing and said button head, a button pin; and wherein said housing has one slot, said button head guide has two slots and said button head has at least one hole, whereby all slots and holes of said plates and operating mechanism are aligned to receive said button pin.

14. The insulative window assembly of claim 11, wherein said blind cover further includes a cover back and a top seal having two ends, said top seal movable against said cover back to trap the blind against said cover back, thereby sealing the top of the window space.

15. The insulative window assembly of claim 14, wherein said rail face further includes a rail pin and said top seal further includes a slot at each end; and wherein said rail pin of each rail face is inserted into one of said slots of said top seal, so that said top seal moves away from said cover back when said rail faces open away from said rail back.

16. The insulative window assembly of claim 14, wherein said cover back includes a first strip magnet and said top seal includes a second strip magnet; and wherein said first and second strip magnets are opposite in polarity and are oriented to face each other in order to trap the blind between each other to form a seal.

17. The insulative window assembly of claim 11, wherein said rail back includes a third strip magnet mounted along said rail back; wherein said rail face includes a fourth strip magnet opposite in polarity to said third strip magnet mounted along said rail face; and wherein said third and fourth strip magnets are mounted to aligned in parallel against each other when the rail face closes against the rail back, thereby trapping said blind between said third and fourth strip magnets and providing the sealing of the sides of the window space due to attraction of the strip magnets.

18. The insulative window assembly of claim 11, further including a base mounted at the bottom of the window space and below said rail backs; a fifth strip magnet mounted to the bottom of said blind pull; and a sixth strip magnet opposite in polarity to said fifth strip magnet mounted to said base so that it faces said fifth strip magnet and interconnects with said fifth strip magnet when the blind pull is against said base.

19. The insulative window assembly of claim 11, wherein said rail back includes a female groove and said rail face includes a male groove which fits into said female groove to allow said rail face to rotate about said rail back.

* * * * *